US010820717B1

(12) United States Patent
Harkrider

(10) Patent No.: US 10,820,717 B1
(45) Date of Patent: Nov. 3, 2020

(54) ULTIMATE TANNING LOUNGE

(71) Applicant: Kenneth Troy Harkrider, Carthage, TX (US)

(72) Inventor: Kenneth Troy Harkrider, Carthage, TX (US)

( * ) Notice: Subject to any disclaimer, the term of this patent is extended or adjusted under 35 U.S.C. 154(b) by 0 days.

(21) Appl. No.: 16/602,890

(22) Filed: Dec. 20, 2019

(51) Int. Cl.

| | |
|---|---|
| ***A47C 27/08*** | (2006.01) |
| ***A47C 15/00*** | (2006.01) |
| ***A47C 20/00*** | (2006.01) |
| ***B63B 34/52*** | (2020.01) |
| ***A47C 1/14*** | (2006.01) |

(52) U.S. Cl.
CPC ..... *A47C 27/087* (2013.01); *A47C 1/143* (2013.01); *A47C 15/006* (2013.01); *A47C 20/00* (2013.01); *A47C 27/081* (2013.01); *B63B 34/52* (2020.02)

(58) Field of Classification Search
CPC ..... A47C 15/006; A47C 7/383; A47C 27/087; A47C 20/026; B63B 34/52
USPC ..... 441/129
See application file for complete search history.

(56) References Cited

U.S. PATENT DOCUMENTS

| | | | | |
|---|---|---|---|---|
| 1,461,911 | A | 7/1923 | Jordan | |
| 3,740,095 | A * | 6/1973 | Nail | A47C 15/006 297/452.41 |
| D258,481 | S | 3/1981 | Kroll | |
| 4,564,240 | A | 1/1986 | Thieme | |
| 4,723,329 | A | 2/1988 | Vaccaro | |
| 4,876,756 | A | 10/1989 | Vaccaro | |
| D349,744 | S | 8/1994 | Wolf | |
| D351,009 | S | 9/1994 | Wolf | |
| 6,142,844 | A | 11/2000 | Klauber | |
| 6,572,424 | B2 * | 6/2003 | Harkrider | B63C 11/49 114/66 |
| D571,429 | S * | 6/2008 | Roberts | D21/803 |
| 9,516,949 | B2 * | 12/2016 | Harkrider | A47C 15/006 |
| 2006/0202523 | A1 | 11/2006 | Wells | |
| 2006/0252318 | A1 | 11/2006 | Krantz | |
| 2012/0156951 | A1 | 6/2012 | Segev | |
| 2013/0280974 | A1 * | 10/2013 | Mulvihill | B63C 11/49 441/135 |
| 2015/0113736 | A1 * | 4/2015 | Cox | A47C 27/087 5/655.3 |

* cited by examiner

*Primary Examiner* — Joshua T Kennedy

(57) ABSTRACT

An inflatable tanning lounge for prone or supine use in absolute comfort, with better resistance to bending. Thus a user laying prone will not hyper-extend their back, because the craft remains straight. An improved headrest design with improved structural integrity preventing the aft perimeter of the headrest from folding down when a user, laying prone, places their forehead upon the aft perimeter of the headrest. Said user's face is removed from the sun, and held above the craft, unconfined, with abundant ventilation in total comfort. When laying supine, the headrest provides a large area for a user's entire head. Lay prone or supine in bed like comfort. Another feature is an open walled cavity vertically through the craft, beneath the headrest and below user's face laying prone. This cavity provides tremendously more space below the user's face, more ventilation, and is claustrophobic friendly.

3 Claims, 9 Drawing Sheets

ULTIMATE TANNING LOUNGE

BACKGROUND

Field of the Invention

Inflatable lounges are often used for tanning. However present day lounges bend in the middle when used. Thereby when a user is laying supine, the user's seated position is much lice in an easy chair. This is not a problem laying in this position. However, when the user has endured enough sun on the front of the body, they must turn over to a prone position. Regrettably, the lounge of today bends, in the middle, hyper extending the user's back, yet removing the front of the body from the sun. Unfortunately, the fixed, non-adjustable head rest or pillow is like that of a bed pillow, the user's head must be turned to the right or left, still receiving more UV rays. This invention relates to a inflatable lounge of PVC, designed for tanning, that provides dedicated comfort lying supine or prone upon a craft design that remains rigid, a headrest that accommodates a user laying supine, or prone with face down, removed from the sun.

Description of Prior Art

There have been many different types of pool floats and lounges produced in the past. In some cases there was an attempt to address comfort when lying prone by giving the face and or head a place to go, such as a hole within the craft. The present invention offers comfort lying prone or supine, with a place for the head to comfortably go. The advantages of this invention will be obvious to the reader.

Prior inventions are as follows: Prior art describes several flotation devices.

US Patent Dec. 258-481 issued Mar. 10, 1981 to Frederick H. Kroll describes a chiropractic mattress or similar article that, when lying prone, embodies a hole in the device for placement of a user's face.

U.S. Pat. No. 4,723,329 issued Feb. 9, 1988 issued to Nick Vaccaro describes an Air Mattress or pedic buoyancy device with a inflatable lumbar cushion on the top of the craft. There is an elongated recess to receive and support a person's head when lying on top of the mattress and holds the head by contacting the user's cheekbones.

U.S. Pat. No. 4,876,756 issued Oct. 31, 1989 to Nick Vaccaro describes an Air Mattress which is a continuation of the above U.S. Pat. No. 4,723,329

U.S. Pat. D571,429 S issued Jun. 17, 2008 to Jeffrey Carlile Roberts describes an Inflatable Pool Float with a pillow at one end of the craft for lying supine and at the other end of the craft an inflated vertical appendage for lying prone.

U.S. Patent 2006/0252318 A1 issued Nov. 9, 2006 to Charles J. Prescott describes a Buoyant Mattress for Snorkeler that embodies a rectangular hole through one end of the craft for a user wearing a scuba mask and snorkel to place their face into the water while the craft supports them.

U.S. Patent 2006,0202523 A1 issued Sep. 14, 2006 to Michael D. Wells describes a Sport Utility Lounge Chair that allows a person to lye prone by placing their face in a padded opening in the lounge. As well as a inflatable embodiment that is hinged for supine positioning.

U.S. Pat. No. 6,142,844 issued Nov. 7, 2000 to Mark Klauber describing a Raft, For a Person in a Face down Position with an opening through one end of the craft for a user to place their face while lying prone and addressing the issue of breathing.

U.S. Pat. No. 1,461,911 issued Jul. 17, 1923 to G. Jordan describes a Pneumatic Support that allows for positions that would assist in learning to swim.

U.S. Patent 2012/0156951 issued Jun. 21, 2012 to Doron Segev describing an Underwater Viewing Facility consisting of a buoyant platform, having a through-hole that employs an underwater observation.

U.S. Pat. No. 4,564,240 issued Jan. 14, 1986 to Gerd Thieme describing Lounge or Reclining Chair Made From a Float-able Plastic Body where by a user can float on the water, supine, in a comfortable reclining chair position.

U.S. Pat. No. 349,744 issued Aug. 16, 1994 to Henry Wolfe describing a Recreational Flotation Device For a Plurality of Users.

U.S. Pat. No. 351,009 issued Sep. 27, 1994 to Henry Wolfe describing a Recreational Flotation Device For a plurality of users with a cross bar.

U.S. Pat. No. 308,712 issued Jun. 19, 1990 to Henry Chang describing a surfing boat.

SUMMARY OF THE INVENTION

In accordance to the present invention, a specially designed inflatable lounge for tanning, featuring improved modifications to craft and headrest of U.S. Pat. No. 9,516,949. Improved design of the craft is a separate in-board air chamber that remains more rigid and resistant to bending in the middle when used. When a tanner lies supine on this craft, the craft is like a bed and the user has a headrest to support the head, while tanning. When the tanner has enough or too much sun, the tanner turns over, prone, to sun their back and the craft does not bend, at all, in the middle. Plus an improved designed headrest for a user to rest their forehead upon, that supports their head face down, comfortably, with no confinements or breathing restrictions, removed from the sun. The present invention provides total, single purpose comfort in a prone position or a supine position with one headrest on just one end of the craft.

Inflatable crafts have been around for some time. People have used them to lounge in pools and lakes and many other uses. However none have been designed for tanning exclusively. The problem that existed in past crafts and present crafts is that they bend in the middle and when laying prone, a user's back would be bent in a hyper-extended manner. Also, there has been no place to rest one's head comfortably and removed from the sun laying prone. Some prior art provided a hole in the craft to place one's head when laying prone. This would be very hot and uncomfortable for summer time use and put the neck and spine out of alignment, causing head, neck and shoulder stress. Not to mention, the build up of carbon dioxide. People with claustrophobia would not be able to use these devices. While other prior art provided no means to support one's head laying supine or prone. While others provided a pillow or head support for supine use only. The present invention provides a improved craft that better prevents bending or sagging when a user lays prone or supine. An improved headrest design that is adjustable, up or down, allowing alignment of head, neck and spine, for total comfort. The improved headrest design provides a large area of support for a user in a supine position and a large comfortable area for a user to place their forehead when in a prone position. Whereby, the face is pointed downward, removed from further UV rays, and held steadfast above the top surface of the craft. Ventilation, with this design, is superlative with open air to each side of the user's face, as well as an open walled cavity disposed vertically through the craft directly below the user's face, provides more space and air flow below the user's head and face. Claustrophobic people will welcome this feature. One craft of bed like comfort, using one side of the craft, with an improved headrest design on one end of the craft, allowing both supine and prone use in unequaled comfort and abundant ventilation around and below a user's face laying prone. Further objects and advantages of this invention will become apparent from a consideration of the drawings and ensuing description.

IT IS THE INTENT OF THIS INVENTION TO SHOW THE FOLLOWING

A. Provide an inflatable craft that can be used laying supine or prone in a comfortable and completely relaxed state by means of an improved, separate air chamber, diamond patterned in-board air chamber design whereby surface area is produced for better weight distribution that keeps the craft structurally more rigid, with absolutely no bending in the middle. Thus the user, laying prone, does not suffer a hyper-extension of the spine but lies in, supported, bed like comfort, as with a supine position.

B. Provide an inflatable craft with an improved headrest, whereby I-beams suspended within the headrest, and parallel, maintain structural shape and aft perimeter portion of the headrest does not fold downward when the user, laying prone, places their forehead on the aft perimeter edge of headrest with their face down, away from the sun, unconfined and well above the top surface of the craft. Providing unobstructed breathing, ventilation and no chance of a carbon dioxide buildup.

C. To provide an improved headrest design, that is large enough too comfortably support a user's entire head, when laying supine.

D. Provide an inflatable craft with a, non-enclosed, open walled cavity vertically disposed through the craft, below the headrest and directly below the user's face, when laying prone, that creates an even larger wide open air space around and below the face of the user. Thereby, better allows for use by claustrophobic users.

E. Provide an open walled cavity vertically disposed through craft whereby a beverage holder is attached, of a webbed or netting material or PVC.

F. Provide an open walled cavity vertically disposed through craft whereby a water proof pocket or pouch is attached, made of PVC or waterproof material, allowing placement of non-water proof items, such as car keys, jewelry, money, wallets etc.

G. Provide an open walled cavity disposed through craft whereby the water at the bottom extreme of walled cavity disposed through craft, provides soothing coolness upon a user's face laying prone or on the neck laying supine.

H. Provide stern boarding handles to assist a user in boarding from the stern, in deep water.

DETAILED DESCRIPTION OF DRAWINGS

Figure 1:
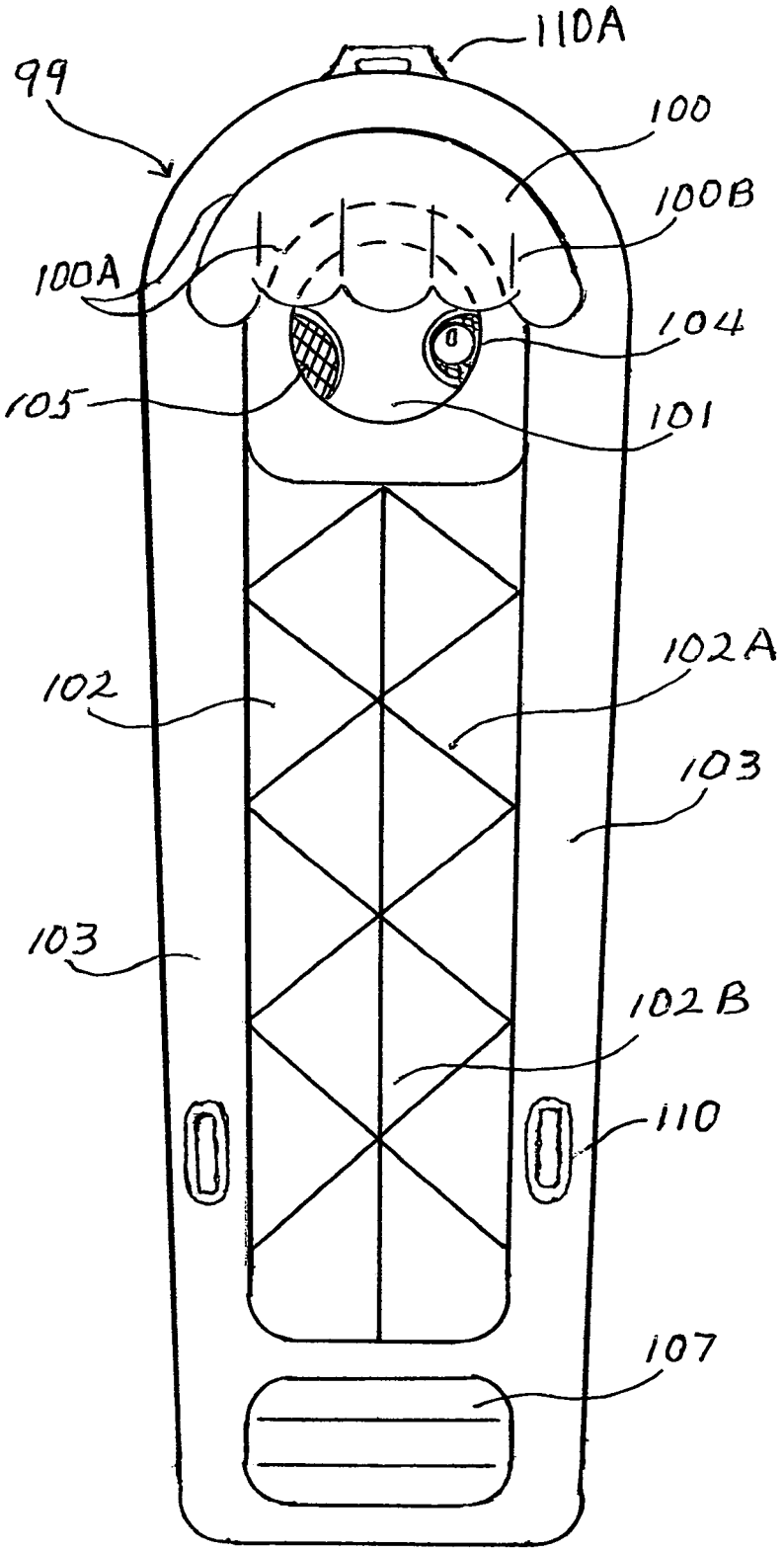
FIG. 1 Top view of craft 99

FIGS. 1, 2, 3, 4, 5, 6, 7, 8, 9—Preferred Embodiment Preferred embodiment of an inflatable tanning lounge of the present invention are illustrated in:

FIG. 1 a top view shows' the layout of the upper surface of craft 99. First is improved headrest 100 and shown is said improved headrest 100 attachment points 100A to said craft 99 in a semi-circle around the perimeter edge of open walled cavity 101 vertically disposed through craft 99. Also shown, from the top view of said improved headrest 100 are I-beams 100B that prevent said improved headrest 100 from a fold down effect 113, as with I-beams that run lateral 111. Due to the semi-circle shape of said improved headrest 100 a large space, beneath said improved headrest 100, is created.

This forms a large said improved headrest 100 area that gives superlative comfort for a user 109 lying supine. Said user 109 can lay prone, to remove their face and front of their body from the sun. Said open walled cavity 101 opens up a large space below the face of said user 109. There is a beverage holder 104 and a pouch of webbed material 105. Said pouch of webbed material 105 is for sun screen, car keys, valuables etc. Stern boarding handles 110 and bow handle 110A are also shown. Said stern handles 110 allows a user 109 to pull themselves onto said craft 99 when in deep water.

The air chambers are next. The first is the out-board air chamber 103 that is a separate air chamber. The next separate air chamber is the improved diamond-patterned inboard air chamber 102. Said diamond pattern in-board air chamber 102 with center I-beams 102B running longitudinal down the center and other I-beams 102A running diagonally in a crisscrossing diamond pattern 102, better distributing a user's weight, providing much more rigidity for said craft 99. The air can not leave this area. There is also the aesthetic stern design 107.

Figure 2:
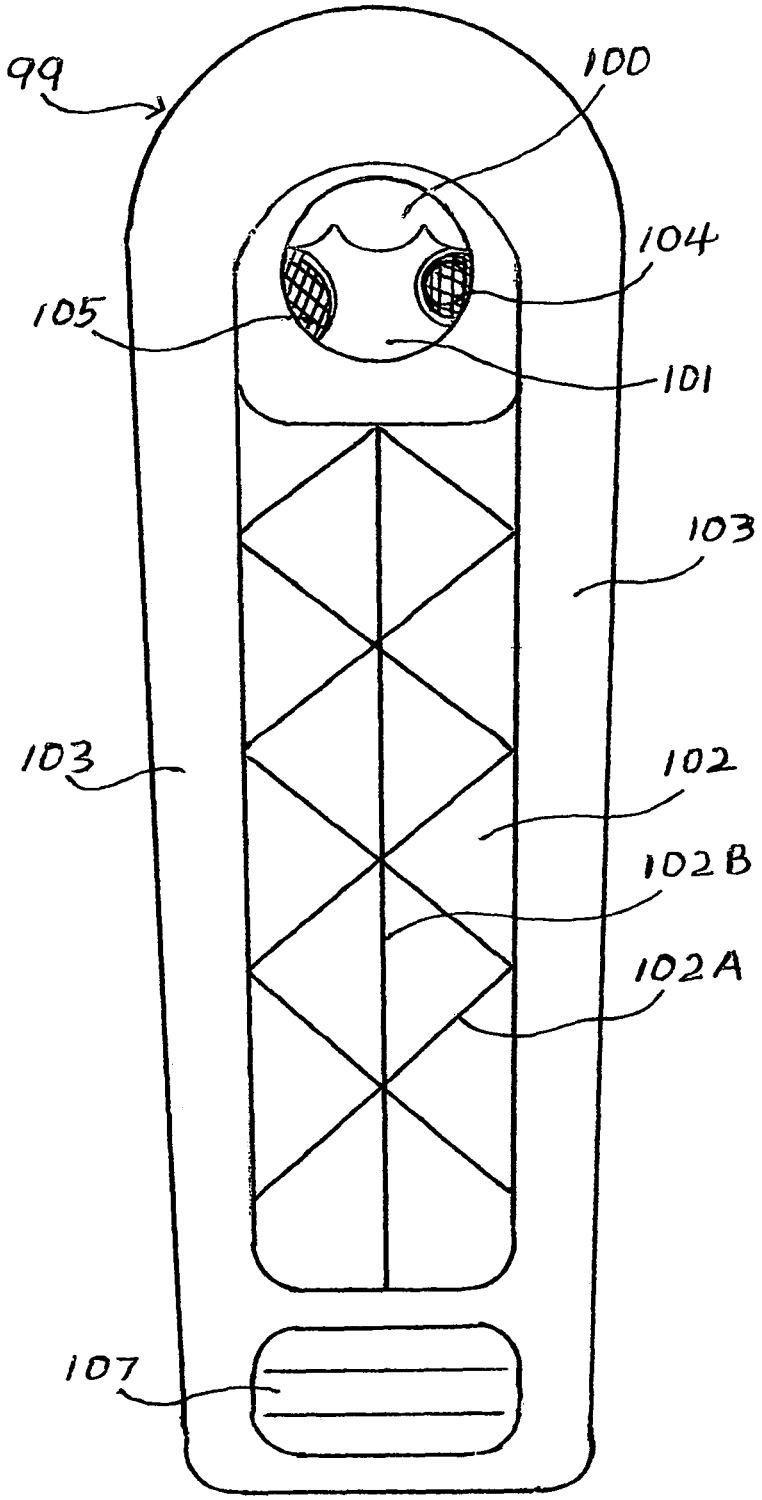
FIG. 2 Bottom view of craft 99

FIG. 2 is a bottom view of said craft 99. Again, one can see said beverage holder 104 of webbed material and said pouch of webbed material 105 and the bottom of said improved headrest 100. As well as said improved diamond patterned in-board air chambers 102. Also shown, said outboard air chamber 103, said center I-beam 102B, said diamond pattern I-beams 102A of improved diamond pattern inboard air chamber 102 and said open walled cavity 101 vertically disposed through craft 99. Not to mention said aesthetic stern design 107.

Figure 3:
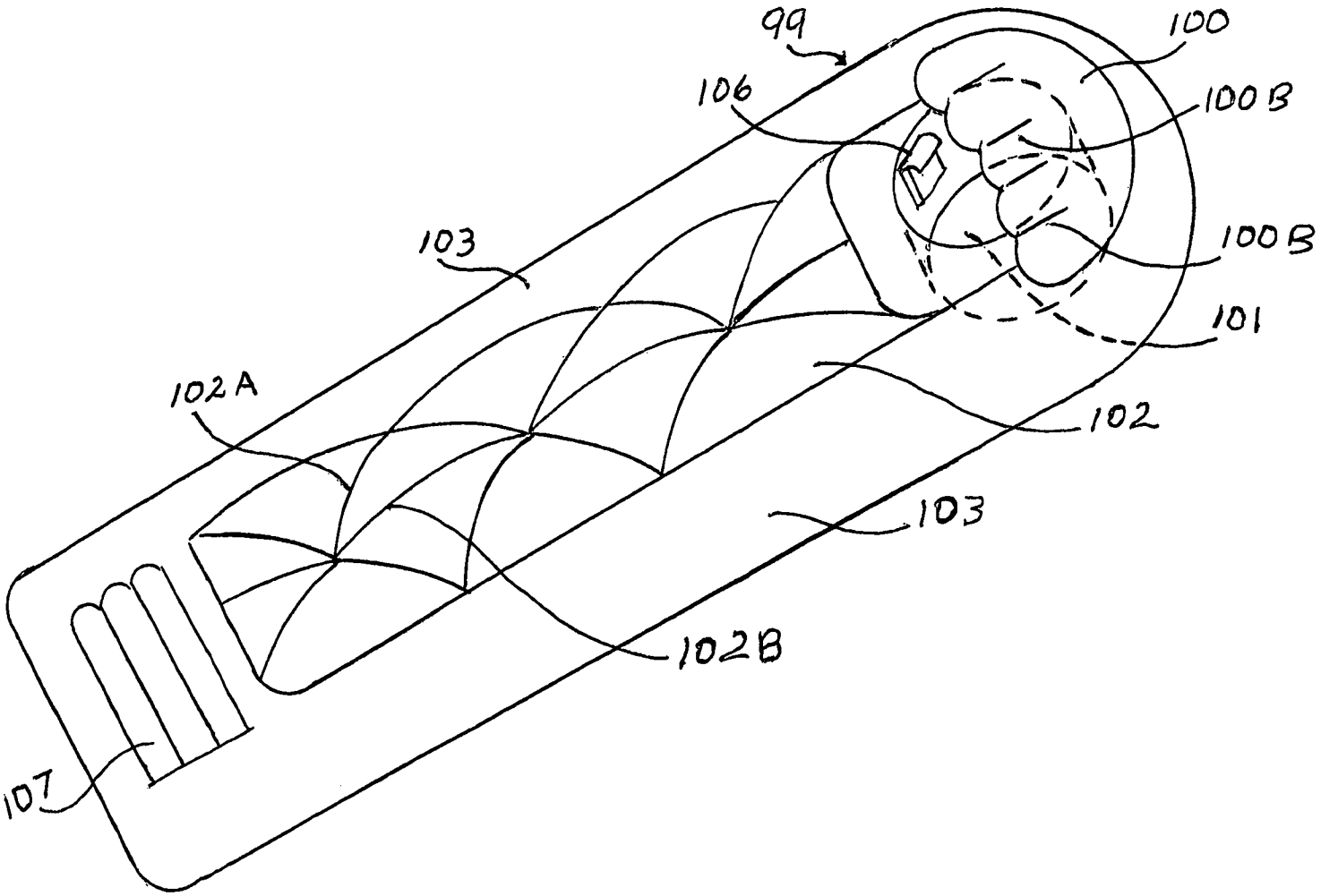
FIG. 3 Perspective view of craft 99

FIG. 3 is a perspective view of said craft 99 showing said improved headrest 100, said walled cavity 101 vertically disposed through craft 99, said pouch of PVC 106 attached within said open walled cavity 101 vertically disposed through craft 99. Said improved diamond pattern inboard air chamber 102 can be clearly seen and said center I-beam 102B and I-beams of diamond pattern air chamber 102A.

Figure 4:
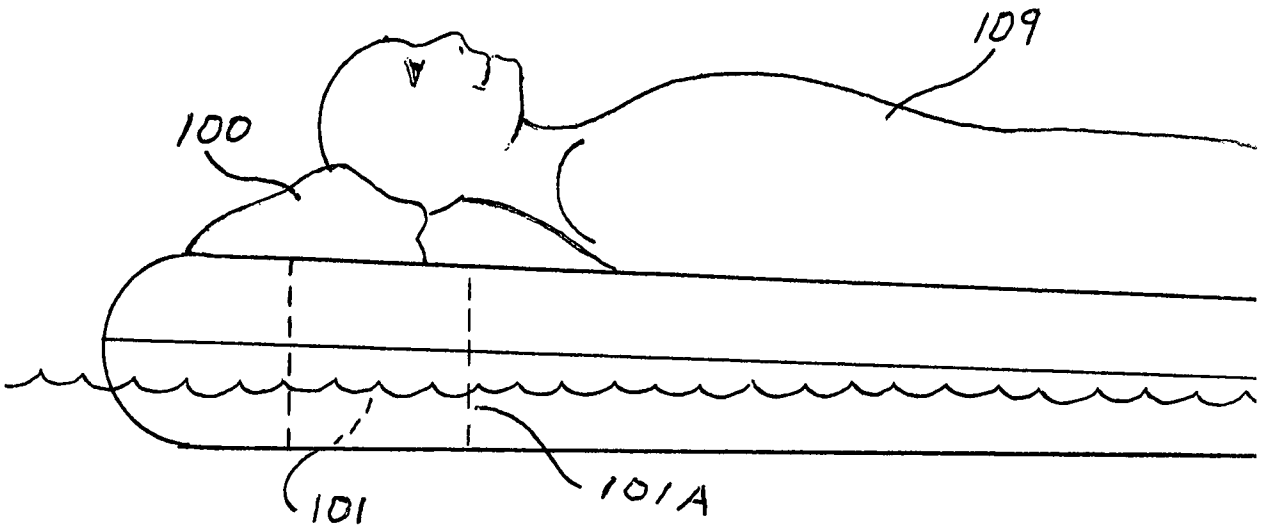
FIG. 4 Side view of craft 99 with user lying supine

FIG. 4 is a side view of said craft 99 showing user 109 laying supine, with head upon said improved headrest 100 and the isometric placement of said open walled cavity vertically disposed through craft 99 and said cavity walls 101A.

Figure 5:
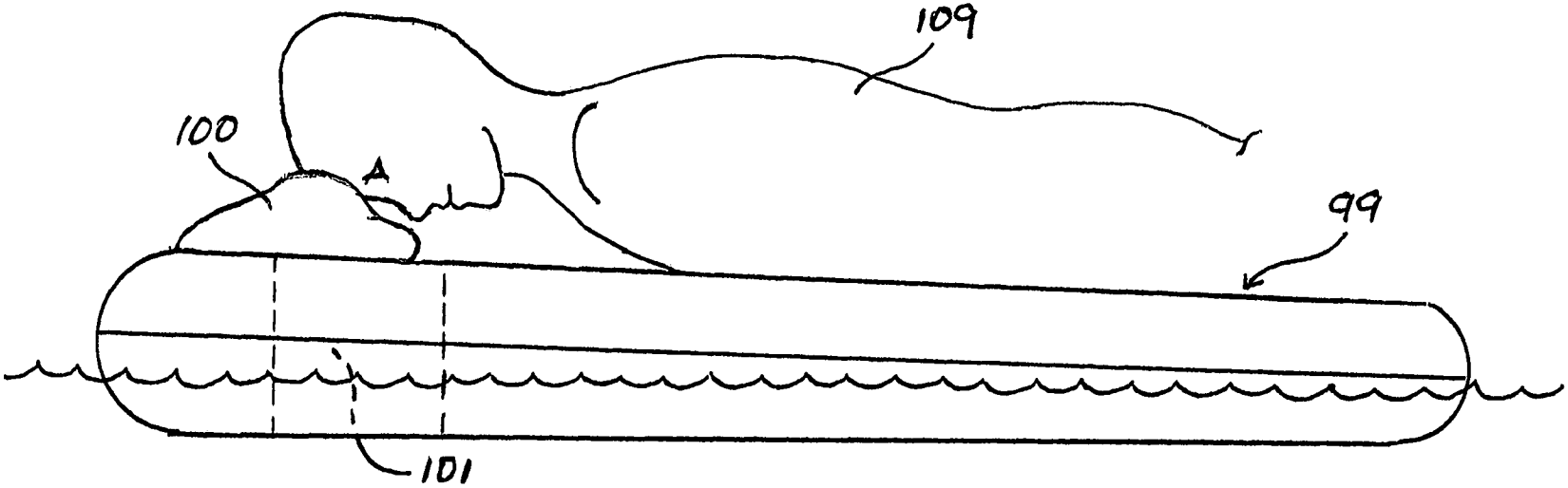
FIG. 5 Side view of craft 99 with user lying prone

FIG. 5 is a side view of said craft 99 showing said user 109 laying prone and again the placement of said open walled cavity 101 vertically disposed through craft 99 and said improved headrest 100.

Figure 6:
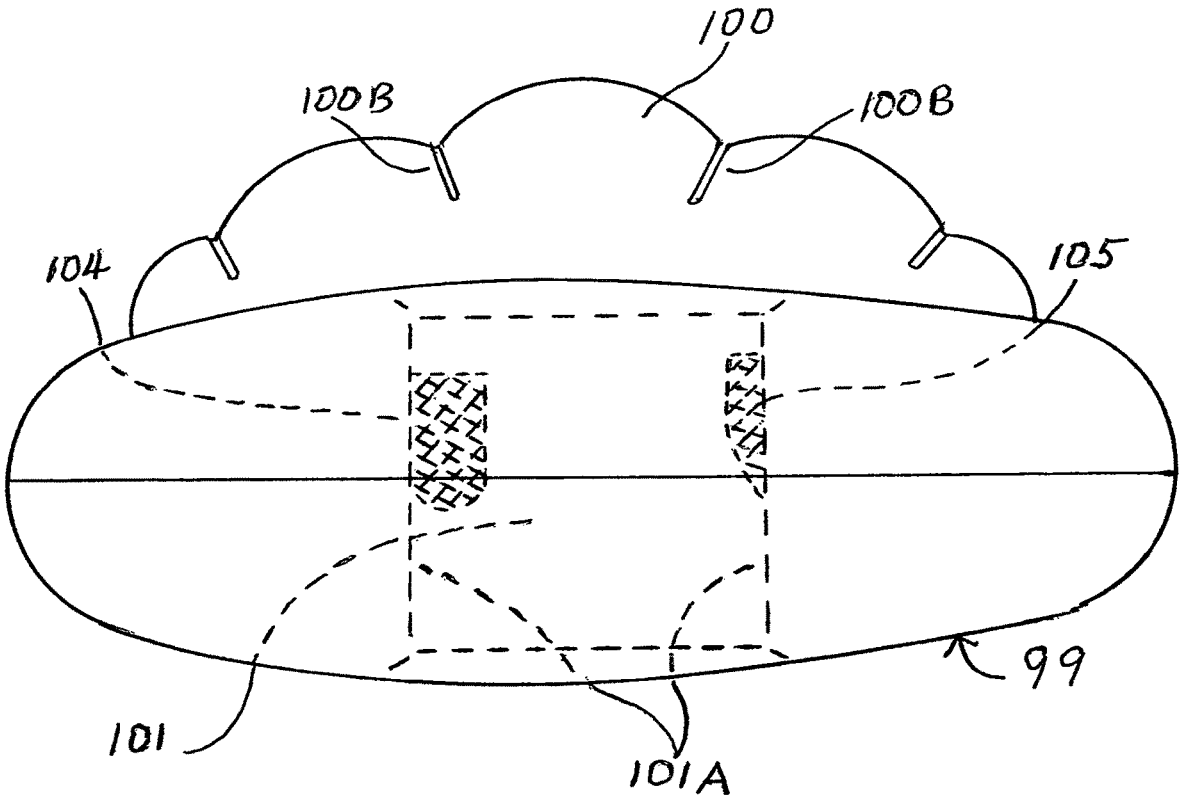
FIG. 6 Front view of craft 99

FIG. 6 is a front view of said craft 99 showing an isometric view of said walled cavity 101 vertically disposed through craft 99 and said beverage holder 104 made of a webbed material and said pouch 105 made of a webbed material. Also shown is said improved headrest 100 with another view of said headrest I-beams 100B, suspended within said headrest 100 and their shaping of said improved headrest 100.

Figure 7:
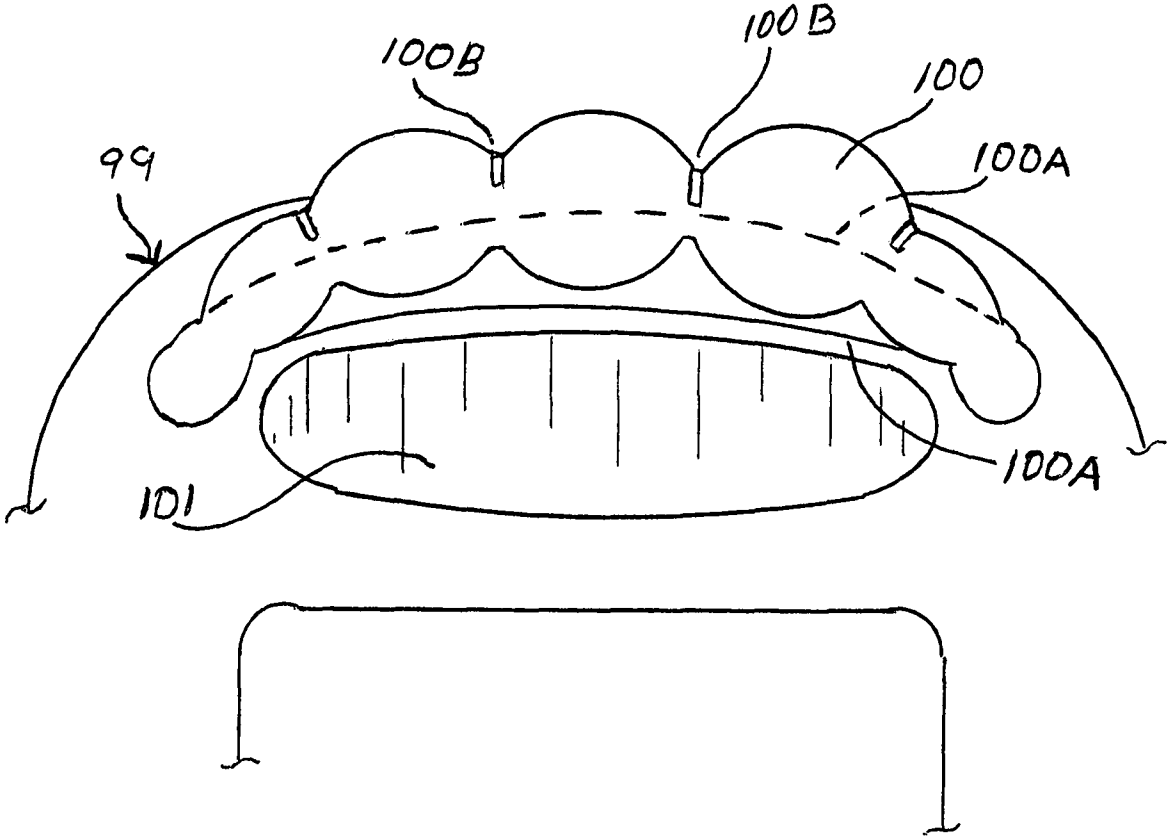
FIG. 7 Rear view of improved headrest 100

FIG. 7 is a rear view of said improved headrest 100. Shown in an isometric manner are said attachment points 100A of said improved headrest 100 to said craft 99 and said I-beams 100B suspended within said headrest 100 and how they form said improved headrest 100 making for a firmer improved headrest 100. This placement and shape of said improved headrest 100 will put a user's face directly over said open walled cavity 101 disposed through craft 99 when laying prone.

Figure 8:
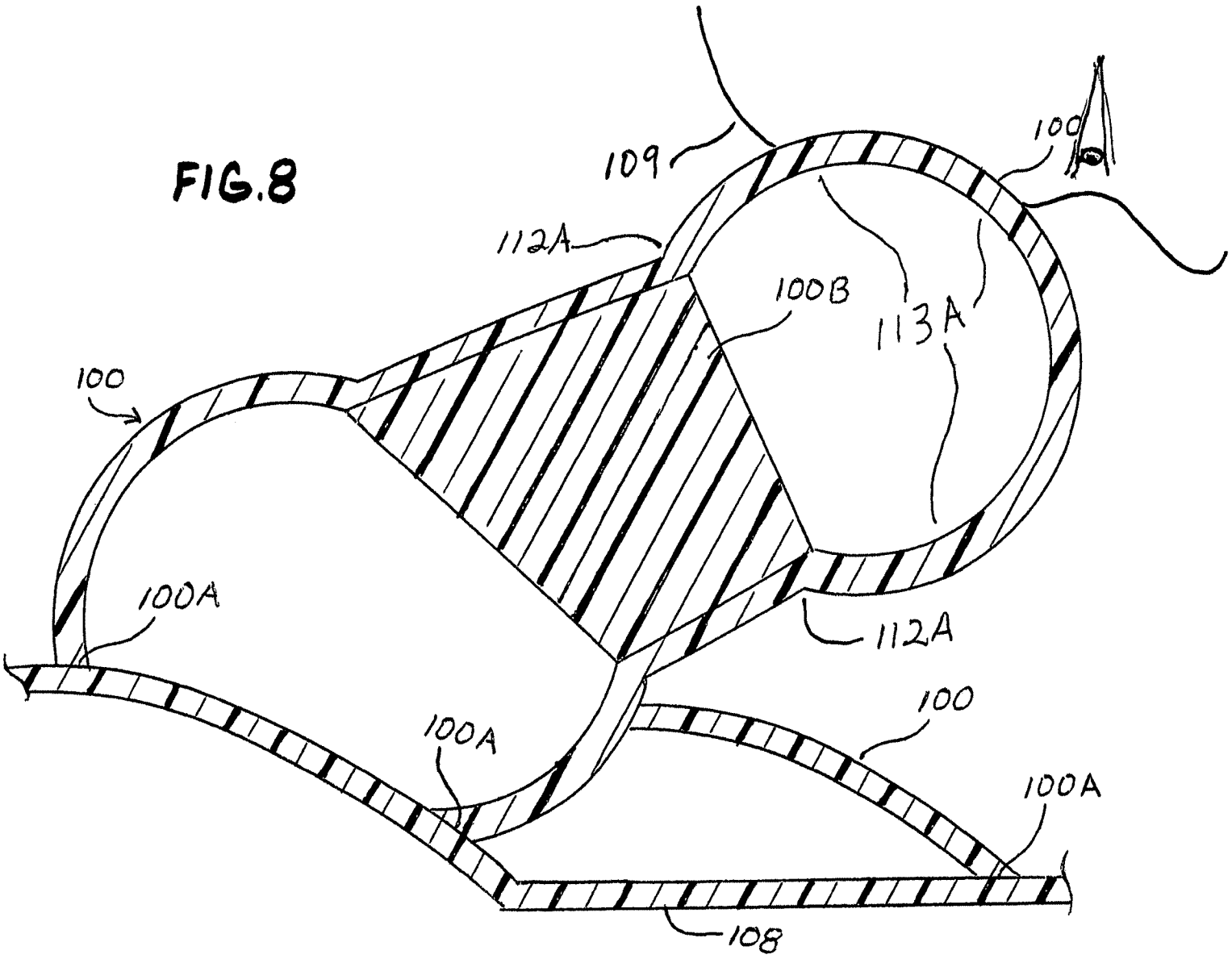
FIG. 8 Isometric side view of improved headrest 100 with I-beams suspended within said headrest.

FIG. 8 is an isometric view of said improved headrest 100. Showing said improved headrest 100, user 109, attachment points 100A to topside 108 of craft 99 and how said I-beams suspended within headrest 100B, allowing no hinge effect 112A, no fold down effect 113 and maintaining the overall shape of headrest 100, when downward pressure of the forehead of said user 109 is applied when used laying prone.

Figure 9:
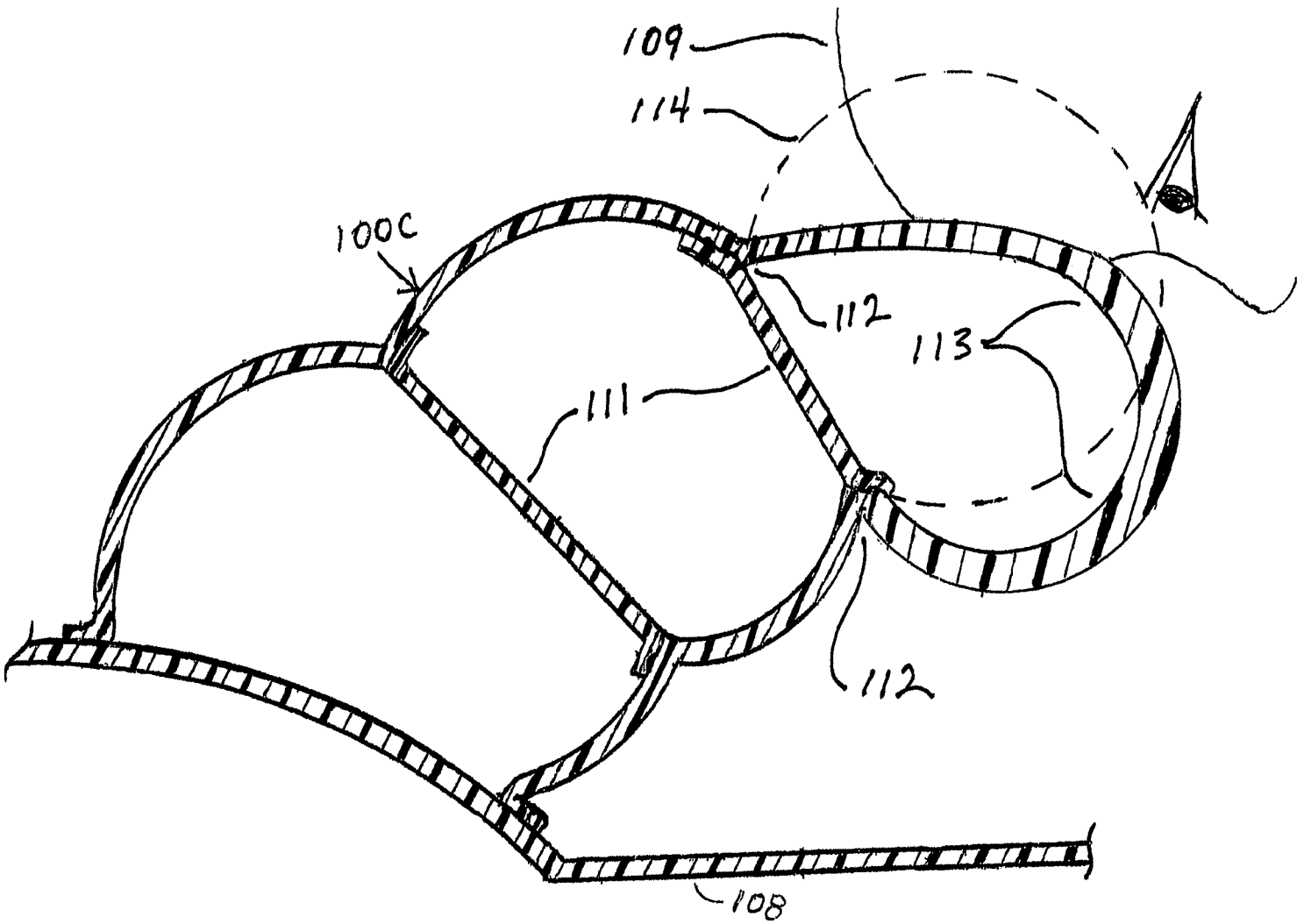
FIG. 9 Isometric side view of headrest 100C with I-beams placed laterally

FIG. 9 is an isometric of said headrest 100C using I-beams 111 running lateral. Showing the original headrest position 114, hinge effect points 112, and fold down effect 113. Thus structurally unfavorable and making desired height adjustments difficult, if not impossible.

This invention is quite simple to operate. Craft 99 can be launched in a number of ways, here is one of two. Standing on the first or second step of a pool, the user 109 turns their back to craft 99 and merely sits in the middle of craft 99. Then swing one leg over craft 99 towards the bow, now user 109 sits straddling craft 99 and looking forward. Next user 109 lays down prone moving the body forward at the same time bringing the legs up and onto craft 99. User 109 now places their forehead on the aft perimeter of the specialty designed improved headrest 100, that is adjustable because it is a separate air chamber, inflate to raise and deflate to lower. Now user 109 can dial in their level of comfort. Thereby, no neck, shoulder, or back stress or pain for anyone. Said headrest 100, laying prone, holds one's face up and over the top surface of craft 99 in complete relaxation with nothing to obstruct or confine the face or restrict ventilation, breathing or cause a carbon dioxide build up. The neck and spine are in-line, also, because craft 99 is not bending, there is no hyper-extending of the spine of user 109, and with the air cushion of craft 99, lies in total relaxation. Furthermore, when laying prone, the face of user 109 is turned downward from the rays of the sun. This rigidity of craft 99 comes from a design having an in-board diamond patterned air chamber 102, with many I-beams 102A, that work independently and collectively. This design creates a surface area to better distributes the weight force of user 109 over the diamond pattern in-board air chamber 102, for improved rigidity, negating sagging or bending of craft 99 in the middle, laying prone or supine in total comfort.

What adds even more refreshing comfort is the open walled cavity vertically disposed through craft 99 directly below eyes and face of user 109. This opens a huge space below the face giving even more ventilation, breathing space and allowing no carbon dioxide build up. This open walled cavity disposed through craft 99 will be soothing and cooling to user 109, laying prone, because, when in use, cool water at the bottom of the open wall cavity vertically disposed through craft 99 channeling up to the face of user 109. Not to mention, a welcomed feature for those with claustrophobia.

Another enjoyment for user 109, when laying prone, is the beverage holder 104 connected to the upper peripheral wall of open walled cavity disposed through craft 99. Using a straw, user 109 can partake of a cold beverage while laying prone. There are, also attached to the upper peripheral walls of open walled cavity vertically disposed through craft 99, pouches or pockets made also of webbed material 105 or PVC 106, to hold item such as tanning lotion, sunglasses etc or valuables that should not be left pool or beach side.

Now boarding craft 99 to lay supine is just the opposite maneuver of the prone boarding. Here user 109 again stands on the first or second pool step with their back to craft 99 and swings one leg over craft 99 towards the stern and sits straddling the middle of craft 99 looking aft. User 109 now simply lays back, lifts their legs up onto craft 99 and places their entire head in the middle of the large, specially designed and improved headrest 100 that is adjusted to their comfort level, relaxes as if on a bed. Plus, enjoy the coolness, against their neck from the cool water below open walled cavity disposed through craft 99. There may come a time when a user 109 must board craft 99 in deep water. In this event the stern boarding handles come into play. The user, from the stern of the craft, would reach across and grasp the stern boarding handles and, while kicking, pull themselves onto the craft. This concludes the operation and features of craft 99.

CONCLUSION, RAMIFICATIONS, AND SCOPE

Accordingly, the reader can see that the Ultimate Inflatable Tanning lounge is an entity that has long been denied the sector of the public that are sun worshipers. They, as with anyone, know that a person cannot withstand the sun's rays, on a given part of the human body, for an indefinite period of time. If one is lying supine or prone, at some point, they must turn over to avoid burning, There is no lounge or device on the market today, in the way of a inflatable device, which can give protection to a person's face when lying prone, tanning, in a comfortable manner. A person lying supine on devices that are on the market today, may have a stationary pillow, like that of a bed, which works well in a supine position. Yet laying prone the user must turn their face to right or left and remaining in the sun. However none of these devices of a lounge design are constructed in a manner to remain straight, they sag in the middle when used. The present lounge does remain substantially straighter, due to the improved middle and in-board separate air chamber design. Wherein the I-beams are woven in a diamond pattern. This design distributes, more evenly, the pressure of a user's weight to each individual diamond shaped pattern. This, in conjunction with the separate out-board air chamber, creates a craft of an improved structural rigidity.

The headrest design of the present invention is designed with I-beams that are suspended parallel within the headrest, thus preventing the aft edge of the headrest from folding or sagging downward with the pressure created from a user's forehead. The overall shape of the headrest is maintained, making height adjustments exact.

The headrest design of U.S. Pat. No. 95,160,949 has the I-beams running laterally. When a user places their head upon the headrest it folds downward from the aft I-beam in a hinging action, distorting the overall shape of the headrest and miss aligning the user's head, neck and spin. Making height adjustments difficult, if not impossible, because the aft portion of the headrest does not remain in place.

The craft embodies an open walled cavity vertically disposed through the craft slightly aft of and below the headrest. This is a rather large cavity through the craft that greatly increases the space below and around the user's face and makes it a refreshing feature for all, especially those who suffer from claustrophobia. Not only that, when the craft is in the water the ambient temperature of the water at the lower extremity of the cavity is cooler than that of the surrounding air. Thereby the cavity contains that coolness and channels it up to the user's face laying prone and neck laying supine.

There is a pouch(s) or pocket(s) attached to the upper peripheral wall of the cavity to hold items such as tanning lotion, car keys, room keys, money or other valuables. Understandably, if these pocket(s) were placed on the exterior of the craft they would be more vulnerable to casual thieves, not so much contained within the cavity, out of sight out of mind, especially if these pockets have lid covers. Inside the cavity, also, is a beverage holder that allows the user, using a straw, to enjoy a cold beverage while laying prone or a long tube type straw for supine use.

An additional embodiment, not shown, is a book holder that can be attached to the top of the cavity made of a material such as netting or PVC that holds an open book for the user's reading pleasure while laying prone.

The present inflatable tanning lounge can offer in functionality, a plurality of users, design innovation, unmatched comfort, with no breathing issues or facial confinements. Nothing that would control or limit use time because of discomfort.

This invention can be of any color, size, or shape that does not compromise the comfort of this invention. This inventions lengths are paramount for users of different heights. Lengths can keep feet from extending passed the stern of the craft and into the water or shorter to allow the legs to be cooled in the water.

There could also be a nylon cover for added puncture protection. The stern area of the craft would need to be of a mess or net material to allow water coming from the cut out around the bottom perimeter of cavity disposed through the craft and flowing through between the craft and nylon cover, when moving forward.

A romantic twist would be a tandem model for spouses or lovers or a larger model.

Thus the scope of the invention should be determined by the appended claims and their legal equivalents, rather than by the examples given.

REFERENCE NUMBERS IN DRAWINGS

99 craft
100 improved headrest
100A attachment points of headrest to craft
100B I-beams suspended longitudinally within headrest
100C headrest with lateral I-beams
101 open walled cavity vertically disposed through craft
101A cavity walls
102 diamond pattern inboard air chamber
102A I-beams of diamond pattern air chamber
102B center I-beam
103 out board air chamber
104 beverage holder
105 pouch of webbed material
106 pouch of PVC
107 aesthetic stern design
108 topside of craft
109 user
110 stern boarding handles
110A bow handle
111 lateral I-beams
112 hinged effect
112A no hinged effect
113 fold down effect
113A no fold down effect
114 original headrest position

The invention claimed is:

1. An inflatable tanning lounge, comprising:

an inflatable bed portion comprising an out-board air chamber located about a periphery of said bed portion and a separate in-board air chamber comprising of multiple I-beams arranged in a diamond pattern to evenly distribute weight and increase rigidity;

an open walled cavity vertically disposed within said bed portion adjacent a first end of said in-board air chamber; and a semi-circular inflatable headrest having a first end portion attached to said bed portion around a portion of a perimeter of said open walled cavity and a second end portion extending above a portion of said open walled cavity, said headrest further comprising I-beams suspended between a top and a bottom side of said headrest and extending longitudinally in a central portion between said first end portion and said second end portion to prevent fold down or hinged effects from downward pressure from a user;

wherein the headrest is configured to accommodate a user's head while lying supine or prone on the lounge, providing space below the headrest, when lying prone, to facilitate ventilation during use.

2. The inflatable lounge of claim 1, wherein said open walled cavity further comprises pouches and/or pockets within said cavity comprised of PVC or webbed material configured to hold personal items and/or drinks.

3. The inflatable tanning lounge of claim 1, further comprising stern boarding handles to assist a user when boarding said lounge from said stern of said lounge.

* * * * *